US010160630B1

(12) United States Patent
Chung

(10) Patent No.: US 10,160,630 B1
(45) Date of Patent: Dec. 25, 2018

(54) LIQUID DRAWING APPARATUS

(71) Applicant: Jingle Master International Limited, Road Town (VG)

(72) Inventor: Yeh-Yi Chung, Road Town (VG)

(73) Assignee: Jingle Master International Limited, Road Town (VG)

( * ) Notice: Subject to any disclaimer, the term of this patent is extended or adjusted under 35 U.S.C. 154(b) by 0 days.

(21) Appl. No.: 15/963,746

(22) Filed: Apr. 26, 2018

(51) Int. Cl.

| | |
|---|---|
| ***B67D 1/00*** | (2006.01) |
| ***B67D 1/12*** | (2006.01) |
| ***A47G 23/00*** | (2006.01) |
| ***B01F 3/04*** | (2006.01) |
| *B67D 1/08* | (2006.01) |

(52) U.S. Cl.
CPC ..... *B67D 1/0004* (2013.01); *A47G 23/00* (2013.01); *B01F 3/04794* (2013.01); *B67D 1/1204* (2013.01); *B01F 2003/04872* (2013.01); *B01F 2215/0072* (2013.01); *B67D 1/0888* (2013.01)

(58) Field of Classification Search
CPC .. B67D 1/0004; B67D 1/1204; B67D 1/0888; A47G 23/00; B01F 3/04794; B01F 2003/04872; B01F 2215/0072
See application file for complete search history.

(56) References Cited

U.S. PATENT DOCUMENTS 4,595,121 A * 6/1986 Schultz ..... B01F 5/0413 116/DIG. 8
4,676,283 A * 6/1987 Caldwell ..... B01F 3/04794 141/29
6,508,163 B1 * 1/2003 Weatherill ..... A47G 23/00 261/112.1
8,011,540 B1 * 9/2011 Peckels ..... B01F 3/04099 222/190
8,245,882 B1 * 8/2012 Federighi ..... B01F 3/04503 222/190
8,561,970 B1 * 10/2013 Mills ..... B01F 13/002 261/124
9,630,153 B2 * 4/2017 Lincoln ..... B01F 3/04787
9,862,590 B2 * 1/2018 Chung ..... B67D 1/10
2016/0354733 A1 * 12/2016 Chung ..... B67D 1/10

FOREIGN PATENT DOCUMENTS

| | | |
|---|---|---|
| CN | 205779630 U | 12/2016 |
| CN | 206590882 U | 10/2017 |
| TW | I339704 | 4/2011 |

* cited by examiner

*Primary Examiner* — Frederick C Nicolas
(74) *Attorney, Agent, or Firm* — Wang Law Firm, Inc.

(57) ABSTRACT

A liquid drawing apparatus includes: a main body; a first infusion pipe and an air intake adjustment unit provided on a side of the main body at two different positions; an installation seat and an annular flange disposed at a bottom part of the main body; and a second infusion pipe mounted on the installation seat in such a manner that the second infusion pipe has a portion extending into the main body, wherein the annular flange encloses an outer periphery of the installation seat, wherein the installation seat includes a disc plate having a lower surface and a plurality of protrusions formed thereon, a mounting sleeve is extending axially and downwardly from the disc plate, and a plurality of resilient leaves are formed on an external surface of the mounting sleeve to define at least one air flow passage.

9 Claims, 5 Drawing Sheets

LIQUID DRAWING APPARATUS

BACKGROUND OF THE INVENTION

1. Field of the Invention

The present invention relates generally to a liquid drawing apparatus, and more particularly to a liquid drawing apparatus provided with an air intake adjustment unit for smoothly and conveniently drawing and decanting liquid, such as wine, from a bottle.

2. The Prior Arts

In general, before drinking wine, the step of decanting wine is needed. The purpose of decanting wine is to aerate the wine, which helps open up the aromas and flavors. In order to open up the aromas and flavors of the wine, a liquid drawing apparatus is used to draw the wine from a bottle, and the wine is mixed with air during the drawing process. The liquid drawing apparatus is generally installed with an air intake adjustment unit to permit intake of a desired amount of air according to different types of wines, thereby controlling an amount of the air to achieve an optimal mixing ratio between the wine and the air.

In the conventional liquid drawing apparatuses, for example, Taiwanese Patent No. 1339704 discloses a liquid drawing apparatus, in which the intake air is compressed via an air pump into a liquid container, and under a state that a mouth of the liquid container is hermetically sealed, the compressed air compresses the surface of the liquid in the container such that the liquid is compressed into an insert pipe inserted in the container, and then discharged to an exterior of the container. While the liquid is flowing through the insert pipe, more compressed air is introduced into the insert pipe via an aeration hole of the insert pipe, thereby making the liquid (such as wine) mixed with the air and thus achieving the purpose of decanting wine.

It should be noted that during use of the currently available liquid drawing apparatuses, a tight sealing between a compression unit and a bottle mouth should be maintained. In the conventional liquid drawing apparatus, the air hole has a fixed size, which cannot be adjusted according to the requirement of different types of wines. For example, since white liquor does not need to be decanted, the air hole should be closed. In addition, the drawing pipe of the liquid drawing apparatus has a fixed length, and thus it is inconvenient to carry.

Chinese patent No. CN 205779630 U, which is own by the present Applicant, discloses a liquid drawing apparatus capable of providing a hermetically sealing effect at the bottle mouth during the drawing process, an adjustable drawing pipe in length so as to facilitate to carry, and an adjustable air hole according to the requirements.

Chinese patent No. CN 206590882 U (also published as U.S. Pat. No. 9,862,590 B2), which is own by the present Applicant, discloses a liquid drawing apparatus providing an improvement to Chinese patent No. CN 205779630 U. The liquid drawing apparatus includes an air intake adjustment unit to accurately control the amount of air during the drawing process.

Furthermore, the present invention is provided to improve Chinese patent No. CN 206590882 U, in order to make the liquid drawing apparatus smoother in drawing operation.

SUMMARY OF THE INVENTION

A primary objective of the present invention is to provide a liquid drawing apparatus capable of providing a smoother drawing operation when compared with the prior arts.

In order to achieve the foregoing objective, the present invention provides a liquid drawing apparatus, comprising: a main body; a first infusion pipe and an air intake adjustment unit provided on a side of the main body at two different positions; an installation seat and an annular flange disposed at a bottom part of the main body; and a second infusion pipe mounted on the installation seat in such a manner that the second infusion pipe has a portion extending into the main body, wherein the annular flange encloses an outer periphery of the installation seat, wherein the installation seat includes a disc plate having a lower surface and a plurality of protrusions formed thereon, a mounting sleeve is extending axially and downwardly from the disc plate, and a plurality of resilient leaves are formed on an external surface of the mounting sleeve to define at least one air flow passage.

In one embodiment of the present invention, the disc plate has an outer diameter greater than an outer diameter of a mouth of a wine bottle to be covered by the disc plate.

Preferably, the plurality of protrusions are elongated ribs.

Preferably, the plurality of ribs are arranged radially on the disc plate with respect to an axis of the disc plate.

Preferably, one end of each of the radial ribs extends to an edge of the outer periphery of the disc plate.

Preferably, the plurality of resilient leaves are formed to be an annular shape and arranged parallel to each other along an axial direction of the mounting sleeve.

Preferably, the air flow passages are formed by cutting at least a part of each of the plurality of resilient leaves along the axial direction of the mounting sleeve.

Preferably, two air flow passages are arranged on both opposite sides of an outer periphery of the mounting sleeve.

Preferably, four air flow passages are arranged at 90 degree interval on an outer periphery of the mounting sleeve.

In operating the liquid drawing apparatus of the present invention, the mounting sleeve is inserted into the mouth of the wine bottle, the mouth of the wine bottle will be enclosed by the annular flange, the resilient leaves on the mounting sleeve slightly deform and abut tightly against an inner wall of the mouth of the wine bottle, and the protrusions formed on the lower surface of the disc plate contact and abut against a topmost end of the wine bottle, thereby forming a proper communication between an exterior and the bottle. Therefore, the wine drawn from the wine bottle can be flowing smoothly and the wine can be simultaneously decanted.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

The accompanying drawings are included to provide a further understanding of the invention, and are incorporated in and constitute a part of this specification. The drawings illustrate embodiments of the invention and, together with the description, serve to explain the principles of the invention.

Figure 1:
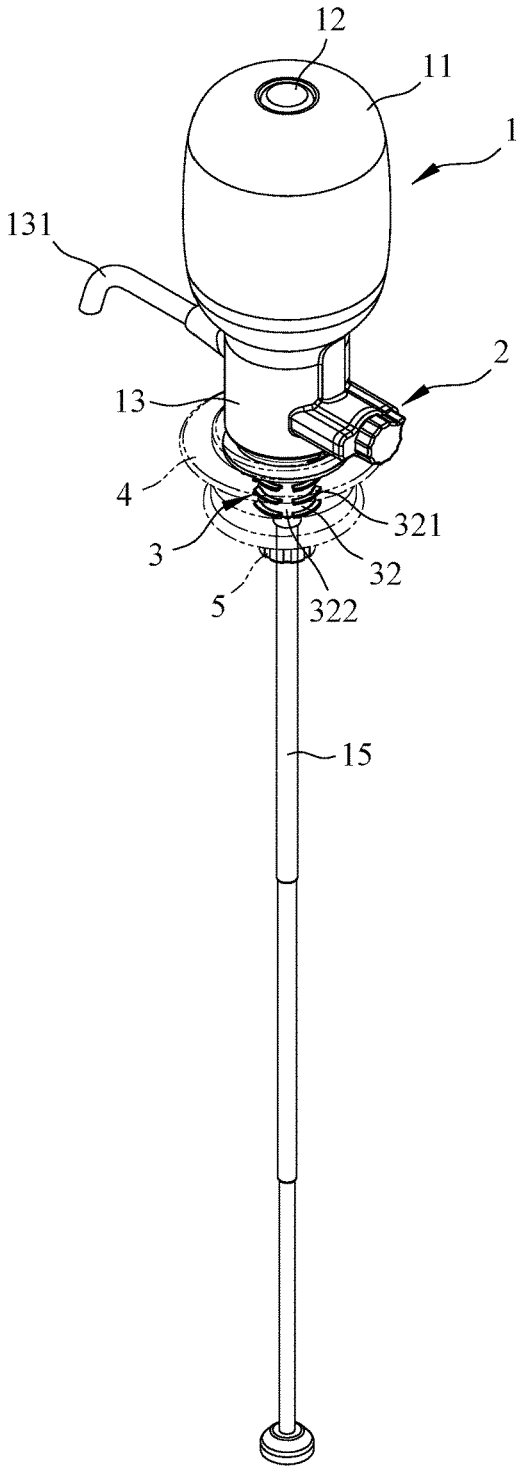
FIG. 1 is a perspective view of a liquid drawing apparatus of the present invention.
Figure 2:
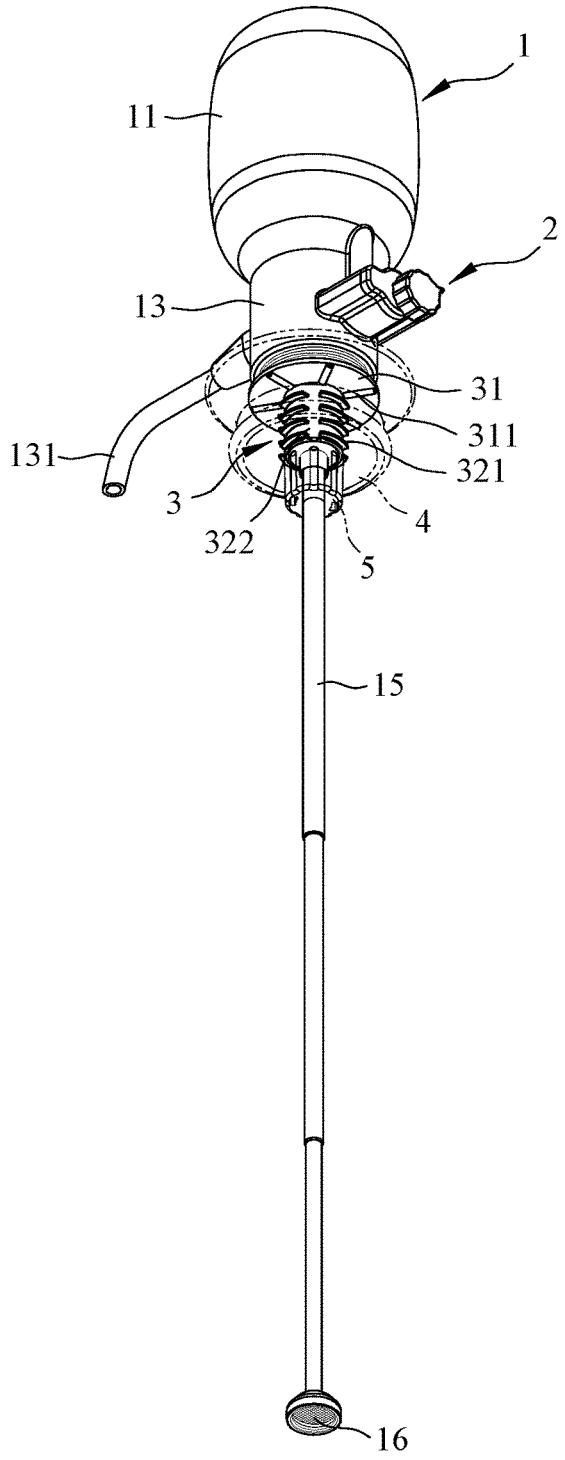
FIG. 2 is a perspective view of the liquid drawing apparatus of the present invention from another direction.
Figure 3:
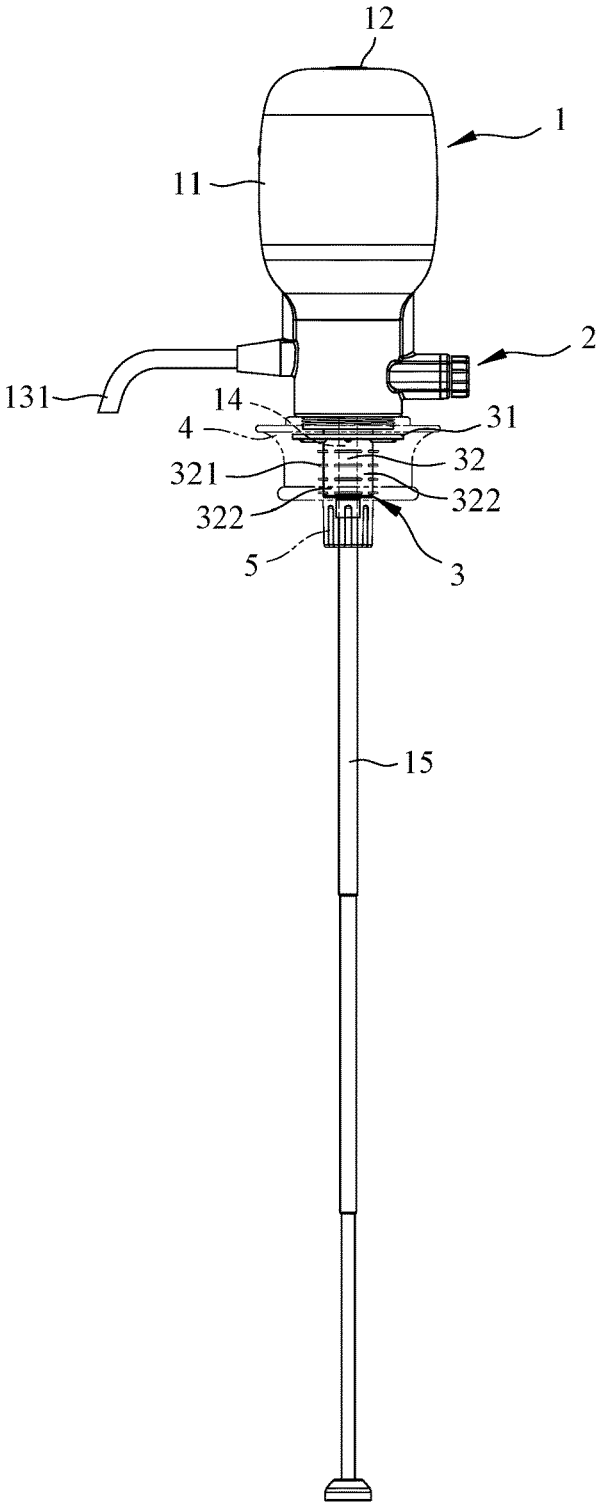
FIG. 3 is a schematic plane view showing the structure of the liquid drawing apparatus of the present invention.

Referring to FIGS. 1-3, a liquid drawing apparatus according to the present invention includes: a main body 1 consisting of a top cover 11 provided with an On/Off switch 12 at a topmost part thereof, a casing 13 connected to a lower part of the top cover 11, and a first infusion pipe 131 and an air intake adjustment unit 2 provided on one side of the casing 13 at two different positions. Alternatively, the first infusion pipe 13 and the air intake adjustment unit 2 may be provided on two opposite sides of the casing 13, as best shown in FIG. 1. An installation seat 3 and an annular flange 4 are disposed at a bottom part of the casing 13. A second infusion pipe 14 is mounted on the installation seat 3 in such a manner that the second infusion pipe 14 has an upper portion extending into the main body 1 and a lower portion extending downward through a connector head 5 for coupling with a drawing pipe 15 exposed to an exterior of the main body 1.

Preferably, the drawing pipe 15 includes a plurality of telescopically connected pipe sections of different diameters so that a length of the drawing pipe 15 can be adjusted according to a height of a wine bottle. A filter mesh 16 is mounted at a bottom end of a lowest pipe section to prevent impurities from being drawn into the drawing pipe 15.

The installation seat 3 includes a circular disc plate 31 having an outer diameter greater than an outer diameter of a mouth of a wine bottle to be covered by the disc plate 31, a lower surface, and a plurality of protrusions 311 formed on the lower surface. The plurality of protrusions 311 are preferably elongated ribs extending radially and outwardly with respect to an axis of the disc plate 31. Preferably, each of the radial ribs 311 is extended to an edge of an outer periphery of the disc plate 31.

A mounting sleeve 32 extends axially and downwardly from the lower surface of the disc plate 31 in a direction opposite to the main body 1. To be more specific, the mounting sleeve 32 is a hollow cylindrical body having an outer diameter smaller than an inner diameter of the mouth of a wine bottle such that the mounting sleeve 32 can be inserted into the mouth of the wine bottle (see FIG. 4). A plurality of resilient leaves 321 are formed on an external surface of the mounting sleeve 32 and are located below the radially extending ribs 311 of the disc plate 31. A plurality of air flow passages 322 are formed through the plurality of resilient leaves 321. For example, the mounting sleeve 32 may be fabricated from elastic materials, and the external surface of the mounting sleeve 32 is integrally formed with the annularly-shaped resilient leaves 321. The plurality of resilient leaves 321 are arranged parallel to each other along an axial direction of the mounting sleeve 32. An outer diameter of the resilient leaves 321 is slightly larger than the inner diameter of the mouth of the bottle. Furthermore, the air flow passages may be formed by cutting at least a part of each of the plurality of resilient leaves along the axial direction of the mounting sleeve. Alternatively, the annularly-shaped resilient leaves 321 are formed by injection mold process to be discontinuous, such that the discontinuous parts form the air flow passages 322.

According to one embodiment of the present invention, there are two air flow passages 322 disposed on both opposite sides of the mounting sleeve 32 and axially extending along an axial direction of the mounting sleeve 32. According to another embodiment of the present invention, there are four air flow passages 322 disposed on the outer periphery of the mounting sleeve 32, spaced apart from each other at 90 degree interval, and axially extending along the axial direction of the mounting sleeve 32. The number of the air flow passages 322 on the mounting sleeve 32 should not be limited and the number may be varied according to the requirement of the intended purposes.

Referring again to FIG. 3, an annular flange 4 has an upper part connected threadedly to an outer threaded portion of the casing 13 in such a manner to enclose an outer periphery of the installation seat 3, and defines a receiving chamber at a lower portion thereof. The receiving chamber has an interior wall surface with a diameter greater than the outer diameter of the disc plate 31 and a plurality of protrusions formed on the interior wall surface such that the threaded connection of the annular flange 4 with the casing 13 results in enclosing the installation seat 3 in the receiving chamber and thus forming an appropriate gap between the inner diameter of the receiving chamber of the annular flange 4 and the outer diameter of the installation seat 3.

The structure of the air intake adjustment unit 2 has been disclosed in detail in Chinese patent No. CN 206590882 U. Since the technical feature of the present application are not directly related thereto, a more detailed description of the same is herein omitted for the sake of brevity.

Figure 4:
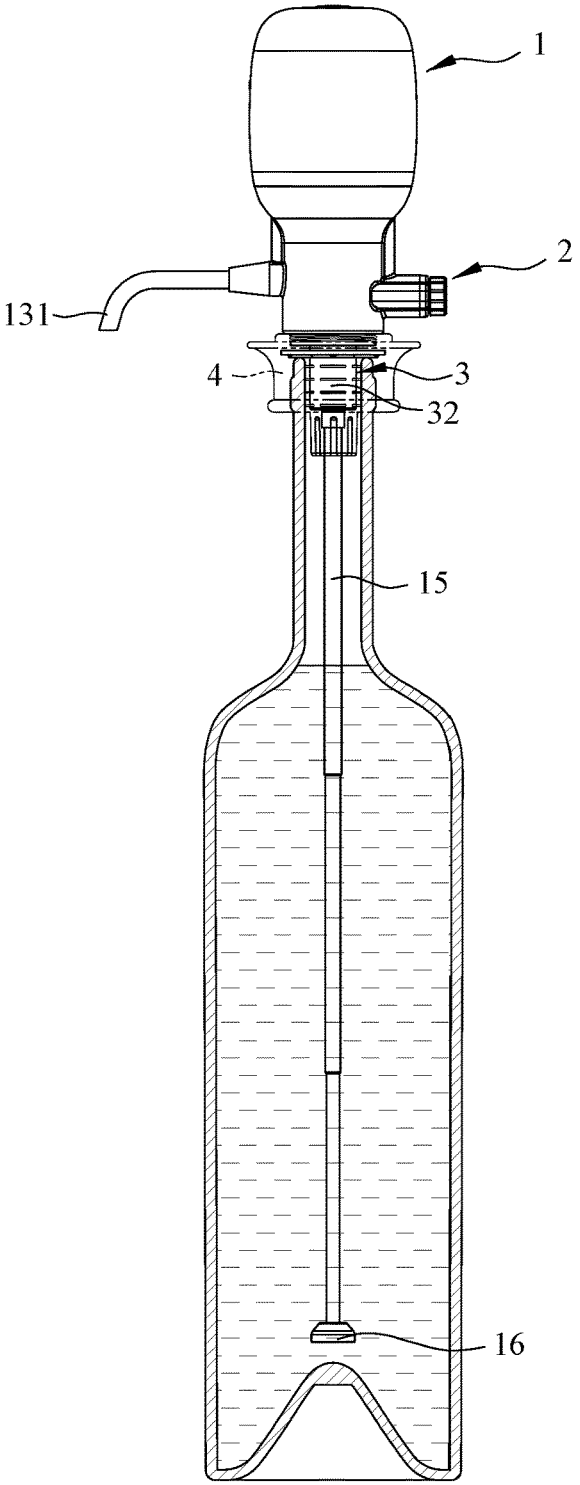
FIG. 4 is a schematic cross-sectional plane view showing the liquid drawing apparatus of the present invention inserted into a wine bottle for drawing wine.
Figure 5:
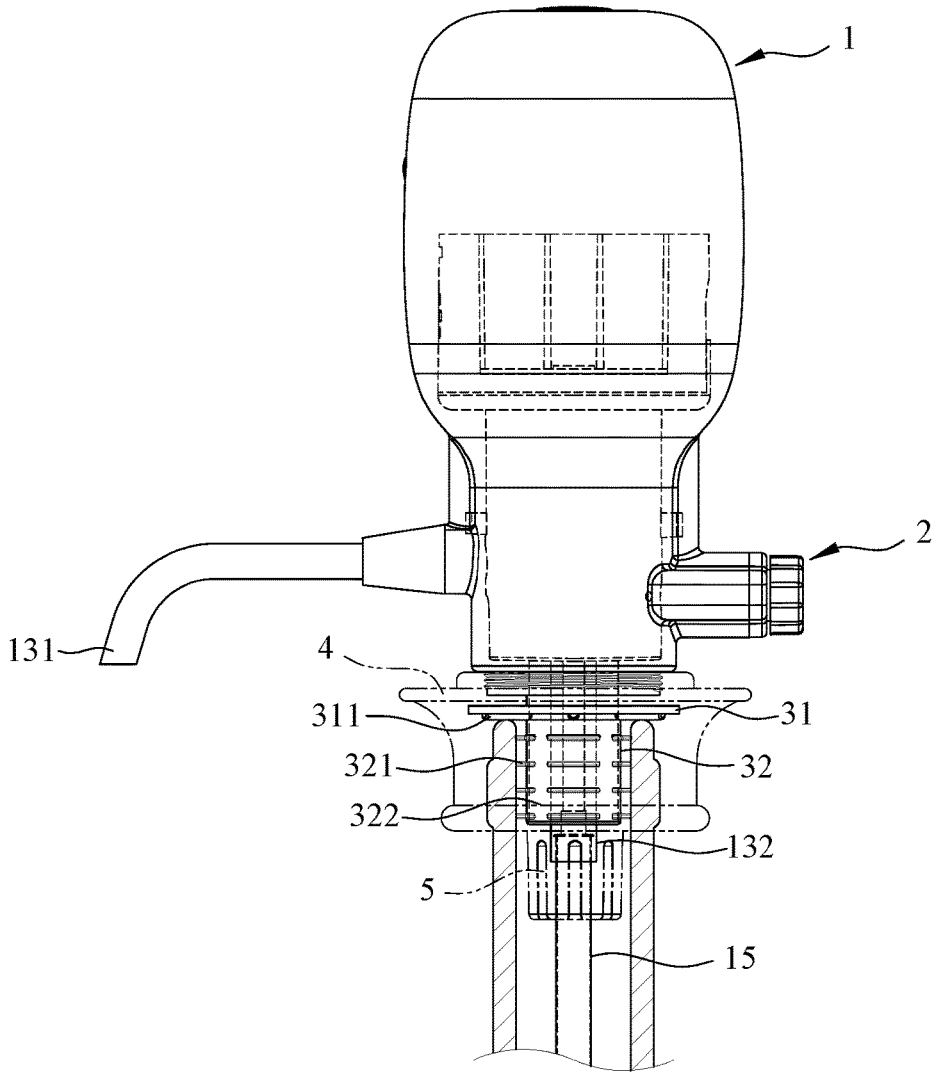
FIG. 5 is a fragmentary enlarged view of the liquid drawing apparatus of the present invention inserted into the wine bottle.

Referring to FIGS. 4 and 5, when using the liquid drawing apparatus of the present invention (when the switch 12 is switched ON) to draw wine from a bottle, the wine is first of all drawn into the drawing pipe 15 and the second infusion pipe 14, then mixed with the air from the air intake adjustment unit 2, and discharged from the first infusion pipe 131 to an exterior.

Referring again to FIGS. 4 and 5, in case of using the liquid drawing apparatus of the present invention to draw wine or whisky that needs to be decanted, the mounting sleeve 32 is inserted into a mouth of a wine bottle in such a manner that the mouth of the wine bottle is enclosed by the annular flange 4, where the resilient leaves 321 on the mounting sleeve 32 slightly deform to abut tightly against an inner peripheral wall of the mouth of the wine bottle, thereby establishing a hermetically seal between the mounting sleeve 32 and the wine bottle. However, the exterior can be communicated with an interior of the wine bottle via the air flow passages 322. Moreover, after full insertion of the mounting sleeve 32 into the wine bottle, the radial ribs 311 formed on the lower surface of the disc plate 31 contact and abut against a topmost end of the wine bottle, thereby forming a gap between the topmost end of the wine bottle and the disc plate 31 such that the gap can be communicated with the air flow passages 322 of the mounting sleeve 32. The amount of the intake air can be adjusted by manipulating the air intake adjustment unit 2. As such, when the switch 12 on the top cover 11 of the main body 1 is switched ON, the external air can be flowing into the wine bottle via the gap between the topmost end of the wine bottle and the disc plate 31 of the installation seat 3 and the air flow passages 322 of the mounting sleeve 32. Therefore, the wine drawn from the wine bottle can be flowing smoothly and the wine can be simultaneously decanted.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A liquid drawing apparatus comprising:

a main body;

a first infusion pipe and an air intake adjustment unit provided on a side of the main body at two different positions;

an installation seat and an annular flange disposed at a bottom part of the main body; and a second infusion pipe mounted on the installation seat in such a manner that the second infusion pipe has a portion extending into the main body, wherein the annular flange encloses an outer periphery of the installation seat, wherein the installation seat includes a disc plate having a lower surface and a plurality of protrusions formed thereon, a mounting sleeve is extending axially and downwardly from the disc plate, and a plurality of resilient leaves are formed on an external surface of the mounting sleeve to define at least one air flow passage.

2. The liquid drawing apparatus according to claim 1, wherein the disc plate has an outer diameter greater than an outer diameter of a mouth of a wine bottle to be covered by the disc plate.

3. The liquid drawing apparatus according to claim 2, wherein the plurality of protrusions are elongated ribs.

4. The liquid drawing apparatus according to claim 3, wherein the plurality of ribs are arranged radially on the disc plate with respect to an axis of the disc plate.

5. The liquid drawing apparatus according to claim 4, wherein one end of each of the radial ribs extends to an edge of the outer periphery of the disc plate.

6. The liquid drawing apparatus according to claim 5, wherein the plurality of resilient leaves are formed to be an annular shape and arranged parallel to each other along an axial direction of the mounting sleeve.

7. The liquid drawing apparatus according to claim 6, wherein the air flow passages are formed by cutting at least a part of each of the plurality of resilient leaves along the axial direction of the mounting sleeve.

8. The liquid drawing apparatus according to claim 7, wherein two air flow passages are arranged on both opposite sides of an outer periphery of the mounting sleeve.

9. The liquid drawing apparatus according to claim 7, wherein four air flow passages are arranged at 90 degree interval on an outer periphery of the mounting sleeve.

* * * * *